United States Patent [19]

Uchida

[11] 4,232,498

[45] Nov. 11, 1980

[54] DEVICE FOR BINDING A THERMALLY ADHESIVE TAPE TO ARTICLES

[76] Inventor: Hiromichi Uchida, c/o Shin Nihon Seiki Co., Ltd., Hoshino Bldg., 7-3, Ueno 5-chome, Taito-ku, Tokyo, Japan

[21] Appl. No.: 927,901

[22] Filed: Jul. 25, 1978

[30] Foreign Application Priority Data

Jul. 25, 1977 [JP] Japan ..... 52-89081

[51] Int. Cl.[3] ..... B65B 13/32; B65B 27/10; B65B 57/16

[52] U.S. Cl. ..... 53/76; 53/583; 53/586; 53/390

[58] Field of Search ..... 53/76, 229, 583, 586, 53/390

[56] References Cited

U.S. PATENT DOCUMENTS

| | | | |
|---|---|---|---|
| 3,039,249 | 6/1962 | Bouchard | 53/583 |
| 3,078,632 | 2/1963 | Forman | 53/586 |
| 3,164,937 | 1/1965 | Ingram | 53/229 |
| 3,307,326 | 3/1967 | Krebs | 53/586 |
| 3,552,091 | 1/1971 | Johnson et al. | 53/586 |
| 3,722,177 | 3/1973 | Michels | 53/390 |
| 3,955,339 | 5/1976 | Kiener et al. | 53/586 |

FOREIGN PATENT DOCUMENTS

| | | | |
|---|---|---|---|
| 2165664 | 7/1972 | Fed. Rep. of Germany | 53/586 |
| 1127579 | 12/1956 | France | 53/586 |
| 1384450 | 2/1975 | United Kingdom | 53/229 |

*Primary Examiner*—John Sipos
*Attorney, Agent, or Firm*—Wenderoth, Lind & Ponack

[57] ABSTRACT

A device for binding a thermally adhesive tape to articles to be bundled, such as spinach, trefoil, asparagus and the like, includes a base, an arm pivotally mounted on the base, a tape supply mounted on the arm, and a working stand provided on the base at a position where the working stand is faced with a free end of the arm when it is pivotally moved to a working position. A working head is provided on the free end of the arm and comprises a cutter to cut the tape from the tape supply, a tape bundling member to hold a tape portion around the articles between the tape bundling member and the working stand when the arm is pivotally moved to the working position, and a tape leading member to lead a new tape leading end from the succeeding tape after the tape portion around the articles is cut. A heater is provided in either of the working head or the working stand so as to heat and bond the overlapped portion of the tape around the articles. A tape holding device is provided to hold a tape leading end at the working stand while the tape leading end is releasable therefrom when the working head reaches the working stand so as to bundle the tape around the articles between the working head and the working stand.

7 Claims, 16 Drawing Figures

DEVICE FOR BINDING A THERMALLY ADHESIVE TAPE TO ARTICLES

BACKGROUND OF THE INVENTION

In the prior art, rubber bands, straws or tapes have been used in order to bundle articles such as vegetables. Such devices are manually tied around the articles, and therefore the operation is ineffective. Heretofore, there has been found no device to automatically bundle such articles and bind a tape to them.

SUMMARY OF THE INVENTION

Accordingly, it is a principal object of the invention to provide a device for automatically binding a tape to articles such as vegetables.

It is another object of the invention to provide a device for binding a tape to articles, wherein the operation of the device is easy and the construction of the device simple.

It is another object of the invention to provide a device for binding a tape to articles wherein a leading end of the tape can be held without any breakage of the tape.

It is another object of the invention to provide a device for binding a tape to articles wherein no tape refuse is left in the device.

It is further object of the invention to provide a device for binding a tape to articles wherein a tape is not led out of a tape supply in an excessive manner with the result that the tape is not slackened.

In accordance with one aspect of the invention, there is provided a device for binding a thermally adhesive tape to articles to be bundled, the device comprising a base, an arm pivotally mounted on the base, and movable between a working position and a non-working position, a tape supply mounted on the arm, a working stand provided on the base at a position where the working stand is faced with a free end of the arm when it is pivotally moved to the working position, a working head provided on the free end of the arm and having a tape bundling member to hold a tape portion around the articles between the tape bundling member and the working stand when the arm is pivotally moved to the working position, a cutter to cut the tape portion from the succeeding tape, and a tape leading member to lead a new tape leading end to the working stand after the tape portion around the article is cut. A heater is provided so as to heat and bond the overlapped portion of the tape around the articles. A tape holding means is provided in the working stand to hold the tape leading end at the working stand while the tape leading end is releasable therefrom when the working head reaches the working stand so as to bundle the tape around the articles between the working head and the working stand.

In accordance with another aspect of the invention, there is provided a device for binding a thermally adhesive tape to articles to be bundled, the device comprising a base, an arm pivotally mounted on the base and movable between a working position and a non-working position, a tape supply mounted on the arm, a working stand provided on the base at a position where the working stand is faced with a free end of the arm when it is pivotally moved to the working position, a working head provided on the free end of the arm and having a tape bundling member to hold a tape portion around articles between the tape bundling member and the working stand when the arm is pivotally moved to the working position, a cutter to cut the tape portion from the succeeding tape, and a tape leading member to lead a new tape leading end into the working stand after the tape portion around the articles is cut from a succeeding tape. A heater is provided so as to heat and bond the overlapped portion of the tape around the articles. Tape holding means is provided in the working stand to hold the tape leading end at the working stand while the tape leading end is releasable therefrom when the working head engages the working stand so as to bundle the tape around the articles between the working head and the working stand. Back tension means pull back the tape so as to apply a back tension to the tape when the arm is being pivotally moved to the working position.

BRIEF DESCRIPTION OF DRAWINGS

The above and other objects and features of the invention will be apparent from the following description of preferred embodiments taken with reference to the accompanying drawings in which.

DETAILED DESCRIPTION OF THE EMBODIMENTS

Figure 1:
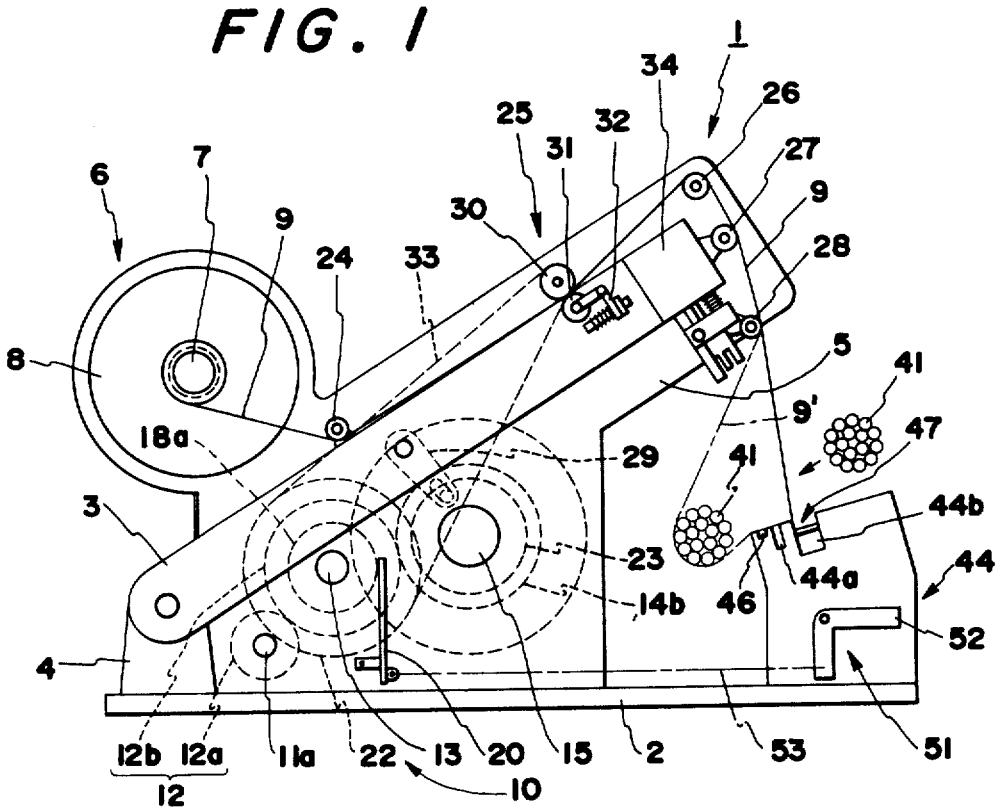
FIG. 1 is a side elevational view of a typical embodiment of the invention when a device is at a non-working position.
Figure 2:
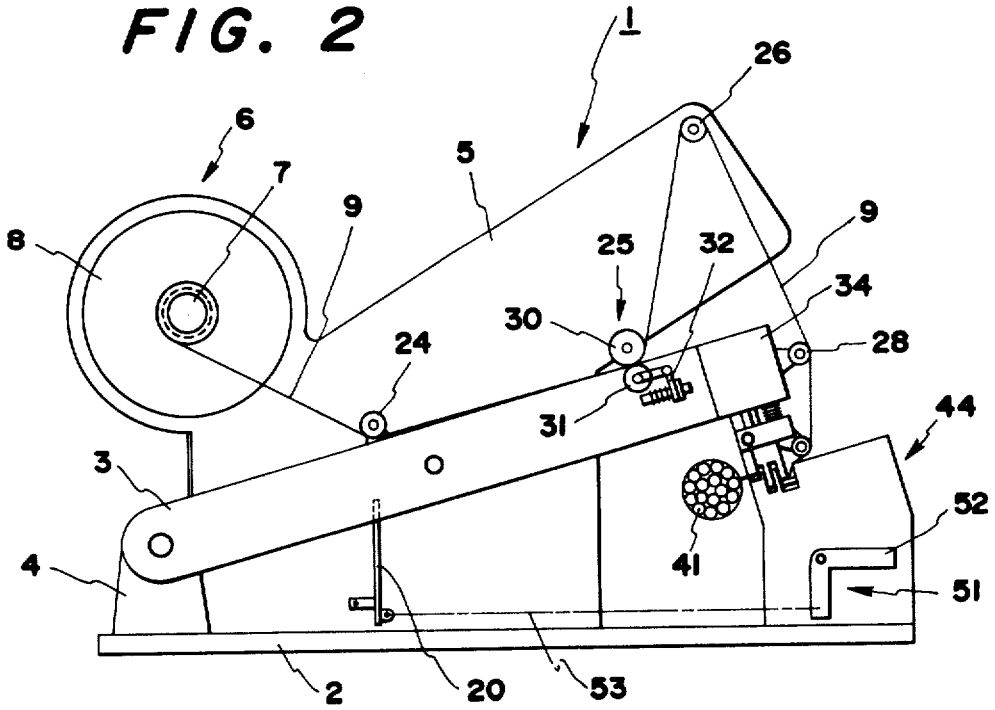
FIG. 2 is a side elevational view of the device of FIG. 1 when it is at a working position.
Figure 3:
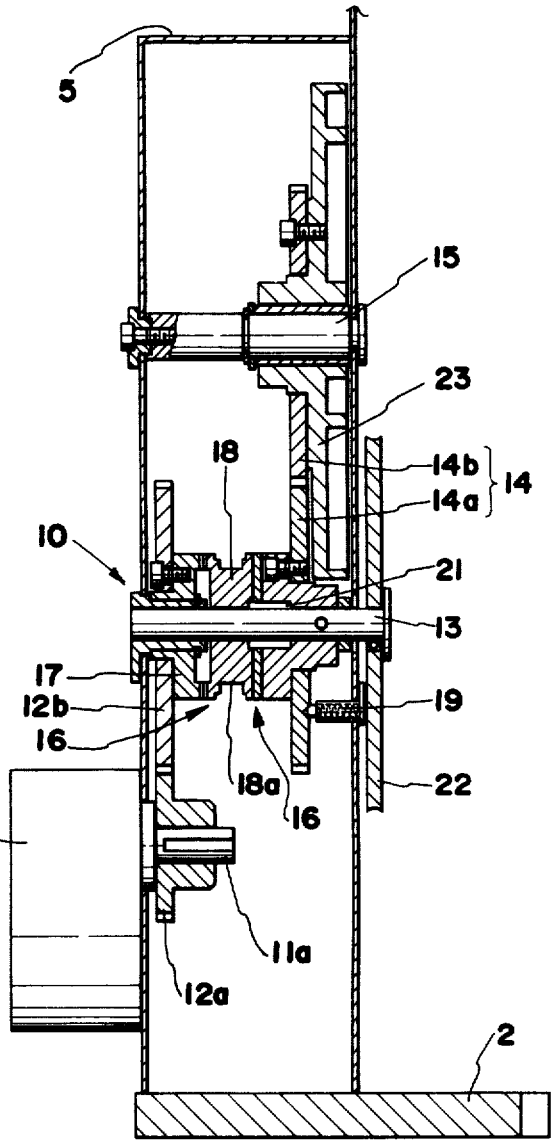
FIG. 3 is an enlarged sectional view of a transmission gear employed in the device of FIG. 1.

Referring now to FIGS. 1 and 2, there is shown a tape binding device 1 constructed in accordance with a typical embodiment of the invention. This device 1 comprises a base 2 and an arm 3 pivotally mounted on a bracket 4 which in turn secured to the base 2. As shown in FIGS. 1 to 3, a support frame 5 is secured to the base 2 and a tape supply 6 is provided on the support frame 5. The tape supply 6 may comprise a reel shaft 7 on which a tape roll 8 is rotatably supported. A thermally adhesive tape 9 is taken out of the tape roll 8.

A transmission device 10 is provided in the support frame 5 as shown in FIGS. 1 and 3, and comprises an electric motor 11 securely mounted on the support frame 5, a first gear group 12 of interengagable gears **12*a* and 12*b*, the gear 12*a* being securely mounted on a motor shaft 11*a* while the gear 12*b* is rotatably mounted on a first rotatable shaft 13 which is in turn rotatably mouted on the support frame 5, a second gear group 14 of interengagable gears 14a and 14b, the gear 14a being securely mounted by key 21 on the first rotatable shaft 13 while the gear 14b is mounted through a key (not shown) on a second rotatable shaft 15 which is in turn rotatably supported on the support frame 5. Clutch means 16 is provided on the first rotatable shaft 13 between the gears 12b and 14a and comprises clutch plates 17 and 18, one of which is secured to the gear 12b and the other of which is secured to the gear 14a, an urging member 19 such as a spring provided between gear 14a and a wall of support frame 5 so as to urge the clutch plates 17 and 18 into engagement and a clutch releasing lever 20 engaged in a groove 18a in the plate 18 so as to normally permit the clutch means to be released, but disengaged from the groove 18a to engage the clutch means when the arm 3** is pivotally moved.

A pulley 22 is provided outside of the support frame 5 and is secured to the first rotatable shaft 13. This pulley serves to pull the tape 9 back, as described below. A rotating disc 23 is secured to the gear 14b so as to rotate together with the gear 14b. This rotating disc serves to pivotally move the arm 3 between the working position as shown in FIG. 2 and the non-working position as shown in FIG. 1, as will be described below.

The thermally adhesive tape 9 is led out of the tape supply 6 through a guide roller 24, back tension means 25 which will also be described below, and guide rollers 26, 27 and 28 into a working stand which will also be described below.

Means to pivotally move the arm 3 comprises a link 29 having one end pivotally connected to a middle portion of the arm 3 and the other end pivotally connected to the periphery of the rotating disc 23. Thus, it will be understood that rotation of the rotating disk 23 causes the arm 3 to make a pivotal movement between the working position as shown in FIG. 2 and the non-working position as shown in FIG. 1.

Back tension means 25 comprises a drive roller 30 rotatably mounted on the arm 3 and a pressure roller 31 forcibly engaging the drive roller 30 by means of a spring-urged lever 32 which is in turn pivotally mounted on the arm 3. A belt 33 is turned about the pulley 22 and the drive roller 30 so that the drive roller 30 is driven by the pulley 22 when the clutch means 16 is engaged.

A working head 34 is provided on the free end of the arm 3 and comprises a support 35 secured to the free end of the arm 3, a tape bundling member 36 slidably extending through the support 35, an operating bar 37 securely supported by the support 35 and a tape releasing member 38 slidably extending through the support 35. A connecting piece 39 is provided to connect the tape bundling member 36 and the tape releasing member 38 to each other and a coil spring 40 is provided around the tape releasing member 38 so as to upwardly urge the tape bundling member 36 and the tape releasing member 38. The tape bundling member 36 serves to bundle around articles 41 a tape portion 9' extending between the working head 34 and a working stand 44, to be described below, when the arm 3 is pivotally moved to the working position as shown in FIG. 2.

A cutter 42 is provided on the lower end of the operating bar 37 and cooperates with the working stand to serve to cut the overlapped portion of the tape 9 around the articles from the succeeding tape after the tape bundling member 36 bundles the tape around the articles 41. A tape leading member 43 is also provided on the lower end of the operating bar 37 to serve to lead a new leading end of the succeeding tape after the tape portion around the article 41 is cut. The tape releasing member 38 is provided with a reversely L-shaped tip 38a which serves to hold the tape between the tip 38a and the working stand and to release tape holding means, which will be described below.

Working stand 44 is provided on the base 2 at a position where it is faced with the free end of the arm 3 or the working head 34 when the arm 3 is pivotally moved to the working position. The working stand 44 is provided with a cutting groove 44a and a tape holding groove 44b, both of which are defined by a wall 45 having an opening 45a provided therein. The cutting groove 44a serves to receive the cutter 42 when it is lowered. The tape holding groove 44b serves to receive the tape leading member 43 and the tip 38a of the tape releasing member 38 when they are lowered.

Figure 4:
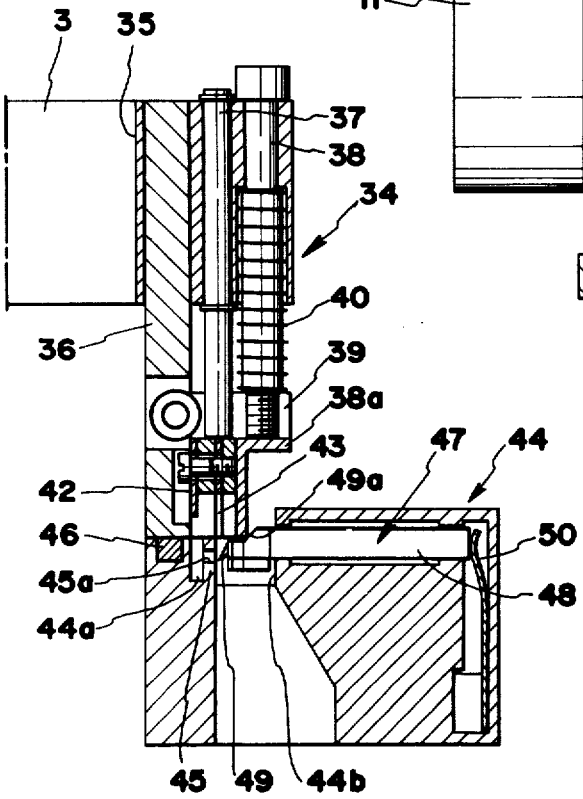
FIG. 4 is an enlarged sectional view of a working head and a working stand when the device is at the working position.
Figure 5A:
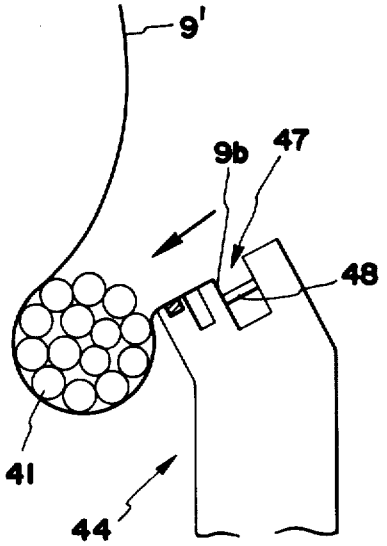
FIGS. 5A to 5C illustrate sequential operations of the device of FIG. 1.
Figure 5B:
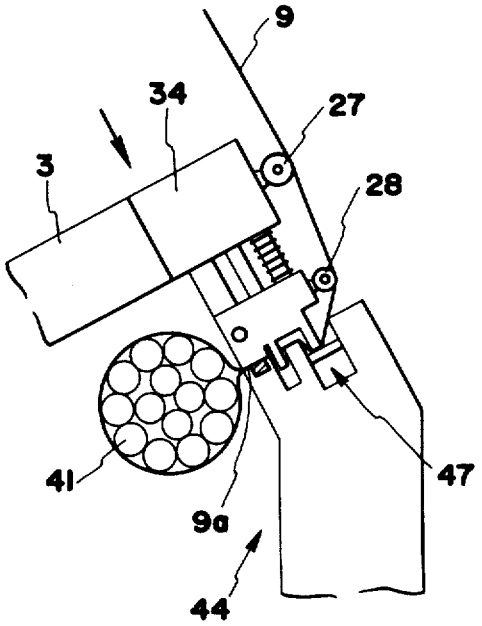

A heater 46 is provided in the working stand 44 so that it heats and bonds the overlapped portion 9a of the tape around the article 41 (see FIG. 5B). It will be understood that the heater 46 may be alternatively provided in the tape bundling member 36 of the working head 34. Tape holding means 47 is provided in the working stand 44 and comprises a tape holding bar 48 horizontally extending through the working stand 44 so that it is slidable so as to face the opneing 45a in the wall 45. The tape holding bar 48 includes a tip 49 engagable with the opening 45a in the wall 45 while the tip 49 pierces the tape leading end 9b (see FIG. 5a). Thus, it will be noted that the tape holding means 47 holds the tape leading end 9b at the working stand as shown in FIGS. 1 and 2. The tip 49 of the tape holding bar 48 is provided at the upper portion with a inclined surface 49a which is engaged by the tape releasing member 38 of the working head 35 so that the tip 49 of the tape holding bar 48 is retracted from the opening 45a in the wall 45 so as to release the tape leading end 9b. A leaf spring 50 is provided in the working stand 44 so that it urges the tape holding bar 48 to be advanced in a leftward direction as viewed in FIG. 4.

Clutch engaging means 51 comprises an engaging handle 52 pivotally mounted on the working stand 44 and a rod 53 having one end connected to the clutch engaging handle 52 and having the other end connected to the clutch releasing lever 20. Thus, it will be noted that the clockwise movement of the clutch engaging handle 52 as viewed in FIGS. 1 and 2 causes the clutch means to be engaged so as to operate the working head 34.

In operation, by driving the electric motor 11, the first gear group 12 including the gears 12a and 12b and the clutch plate 17 of the clutch means 16 are being rotated while the arm 3 is at the non-working position as shown in FIG. 1. In this condition, the articles 41 such as vegetables to be bundled are placed on the tape portion 9' extending between the working head 34 and the working stand 44 and forced in a downward direction as indicated by the dotted line in FIG. 1. This is also shown in FIG. 5A. Thereafter, the clutch engaging lever 52 is moved in a clockwise direction as viewed in FIG. 1 to release the clutch lever 20 from the clutch plate 18 so as to engage the clutch plates 17 and 18 of the clutch means 16. Thus, the second gear group 14 including the gears 14a and 14b are rotated, and as a result, the pulley 22 of the back tension means 25 and the engaging disc 23 are rotated. The rotation of the engaging disc 23 causes the arm 3 to be pivotally moved in a clockwise direction as viewed in FIG. 1 to the working position shown in FIG. 2 while the rotation of the pulley 22 causes the guide roller 30 to be rotated in a clockwise direction as viewed in FIG. 1 so as to apply a back tension to the tape 9. The back tension to the tape restrains the tape from being slackened while the arm 3 is pivotally moved or lowered.

When the arm 3 together with the working head 34 reaches the working position by a continuous rotation of the arm 3 as shown in FIGS. 2 and 5B, the tape bundling member 36 bundles the tape around the articles 41 while the tape is held between the tape bundling member 36 and the working head 44. At the same time, the tip 38*a* of the tape releasing member 38 engages the inclined surface 49*a* of the tip 49 of the tape holding bar 49, and as a result, the tape holding bar 49 is disengaged from the opening 45*a* in the wall 45 so as to release the tape leading end 9*b* of the tape out of the opening 45*a*. At that time, the heater 46 becomes electrically conducting so that the overlapped portion 9*a* of the thermally adhesive tape is heated and bonded so as to securely bundle the article 41.

The continuous downward movement of the arm 3 permits the operating bar 37 to be further moved in a downward direction while the tape bundling member 36 and the tape releasing member 38 are held in position by means of contraction of the coil spring 40. Thus, the cutter 42 is lowered and received in the tape cutting groove 44*a* so as to cut the overlapped portion 9*a* of the tape around the articles. At the same time, the new leading end of the tape 9 is led into the tape holding groove 44*b* by means of the downward movement of the tape leading member 43. It should be noted that since the tape is held between the tip 38*a* of the tape releasing member 38 and the inclined surface of the tip 49 on the tape holding bar 48, the tape is never pulled back in an upward direction.

Figure 5C:
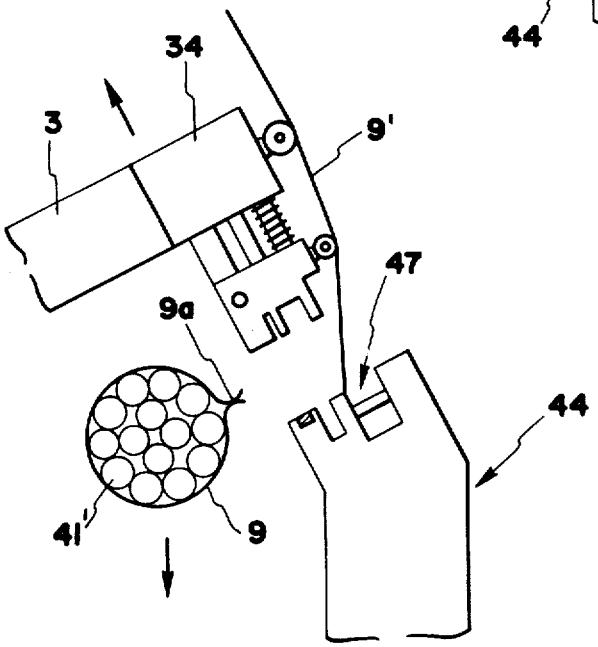

Thereafter, the arm 3 is pivotally moved in an upward direction by means of the link 29 of the arm driving means so that the working head 34 is moved far away from the working stand 44. Thus, the bundled articles 41′ is released from the device 10 as shown in FIG. 5C and dropped on the base 2. At that time, the tape holding bar 48 is disengaged from the tape releasing member 38 and therefore advanced and engaged with the opening 45*a* by means of the leaf spring 50 so as to hold the new leading end 9*b* of the tape between the wall 45 and the tape holding bar 48.

When the engaging disc 23 is rotated by one revolution, the clutch means 16 is disengaged, and therefore rotation of the second gear group 14, the pulley 22 and the rotating disk 23 are terminated.

Figure 6:
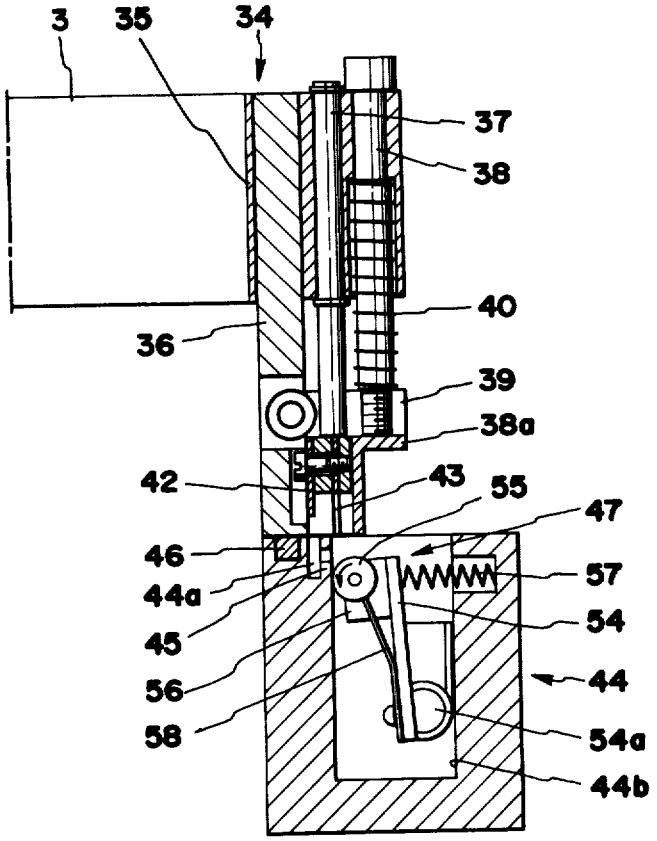
FIG. 6 is an enlarged sectional view of the working head and the working stand constructed in accordance with another embodiment of the invention.

FIG. 6 shows another embodiment of the invention which is substantially identical to the embodiment of FIGS. 1 to 5, except that the tape holding means 47 is modified. The modified tape holding means 47 comprises a lever 54 disposed in the tape holding groove 44*b* and pivoted at the point 54*a*, a tape holding roller 55 rotatably supported by a bracket 56 which is in turn secured to the lever 54 and a spring 57 arranged so as to urge the tape holding roller 55 against the wall 45. A leaf spring 58 has a lower end secured to the lower end of the lever 54 and an upper end engaged with the tape holding roller 55 so as to permit the tape holding roller 55 to rotate in a counterclockwise direction as viewed in FIG. 3, but to prevent roller 55 from rotating in a reverse direction. The same numerals designate the same components as in the embodiment of FIGS. 1 to 5. It will be understood that the operation is substantially identical to that of the embodiment of FIGS. 1 to 5. The tip of the tape releasing member 38, when lowered, engages the tape holding roller 55 so as to be moved away from the wall 45. According to the embodiment of FIG. 6, the tape holding member never pierces the tape and a result, the tape leading end is never broken so as to be separated from the remaining tape. Thus, no tape refuse is left in the working stand 44.

Figure 7A:
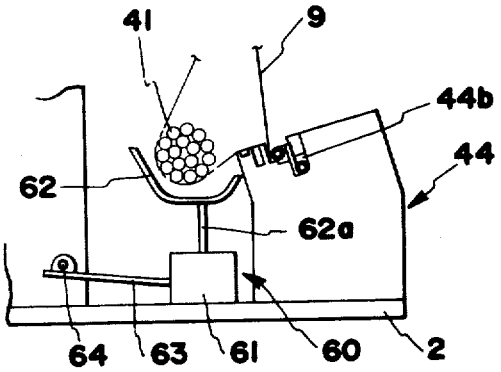
FIGS. 7A and 7B are partial side elevational views of another embodiment of the invention.
Figure 7B:
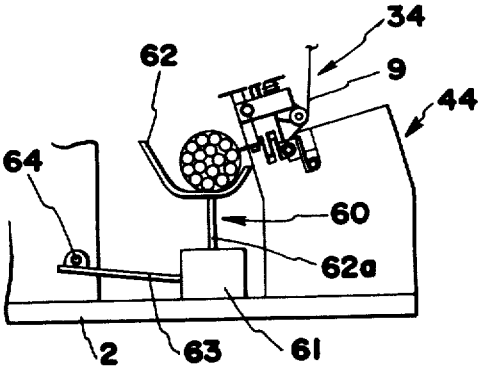
Figure 8:
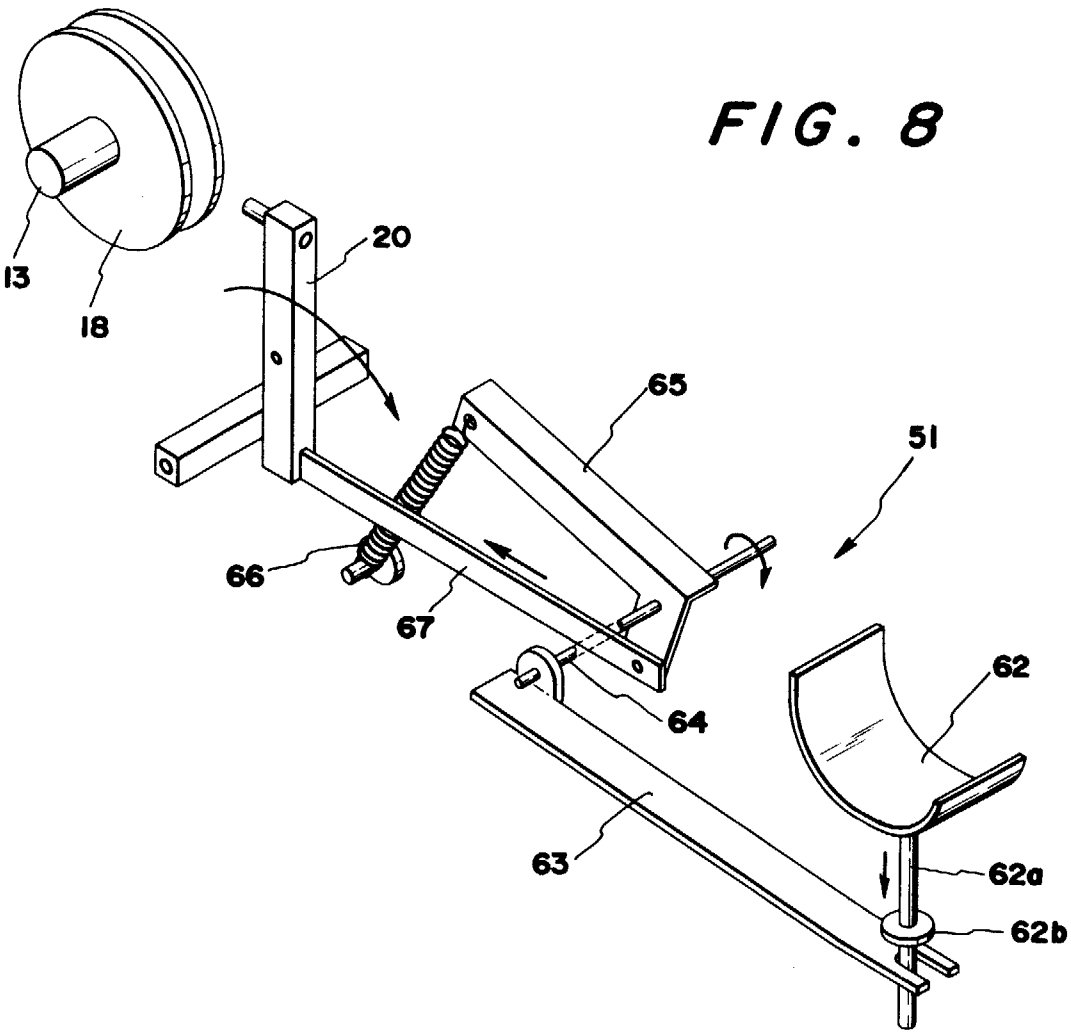
FIG. 8 is an enlarged perspective view of clutch engaging means imployed in the device of FIGS. 7A and 7B.

FIGS. 7 and 8 show another embodiment of the invention which is substantially identical to that of FIGS. 1 to 5, except that the clutch engaging means 51 is modified. The modified clutch engaging means 51 comprises a frame 61 provided on the base 2, an article receiving table 62 having a support rod 62*a* slidably supported by the frame 61, and a first lever 63 pivoted at a shaft 64 which is in turn connected to a pivoting point of a second lever 65. The first lever 63 has a free end extending through the frame 61 and arranged so as to engage a load transmitting portion 62*b* on the support rod 62*a*. Thus, it will be understood that the articles 41 received by the table 62 cause the first lever 63 to be pivotally moved about the axis of shaft 64 in a clockwise direction as viewed in FIG. 8, and therefore, the second lever is also caused to be pivotally moved in the same direction. A spring 66 is provided so as to urge the second lever 65 in a counterclockwise direction as viewed in FIG. 8. A link 67 is pivotally connected between the second lever 65 and the clutch releasing lever 20 of the clutch means 16. Thus, it will be noted that the article 41, while lapped by the tape 9′, is lowered as shown in FIG. 5B to engage the table 62. At that time, the first and second levers 63 and 65 and the clutch releasing lever 20 are pivotally moved in a clockwise direction as shown in FIG. 8, with the result that the clutch means 16 is engaged so as to start the operation of the device. It will be noted that the clutch engaging handle 52 is replaced by the article receiving table 62. In this embodiment, the operator can operate the device even while the articles 41 are carried in his hands.

Figure 9:
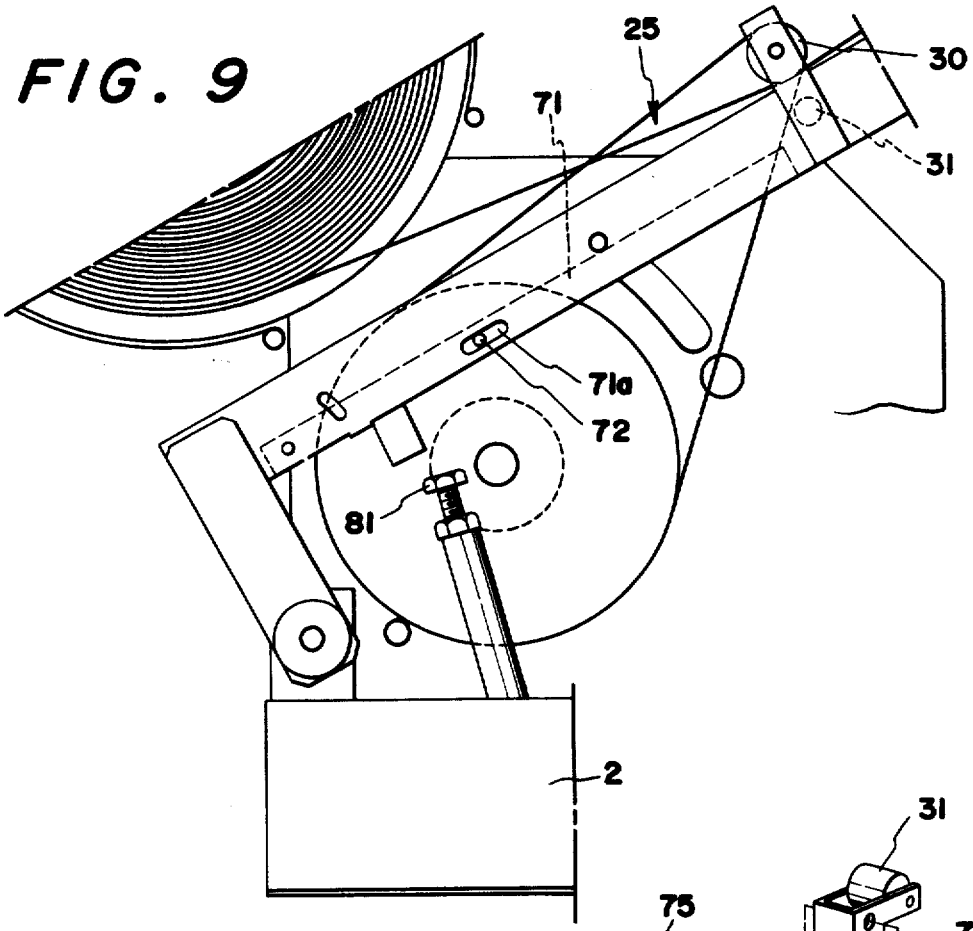
FIG. 9 is a partial side elevational view of further embodiment of the invention.
Figure 10:
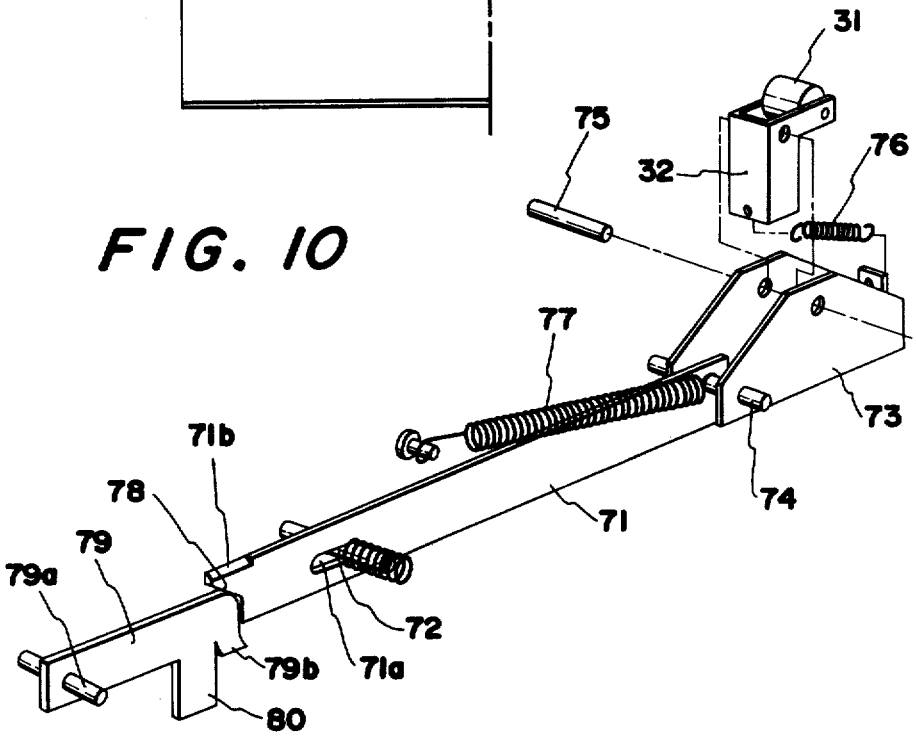
FIG. 10 is an enlarged perspective view of clutch engaging means employed in the device of FIG. 9.
Figure 11A:
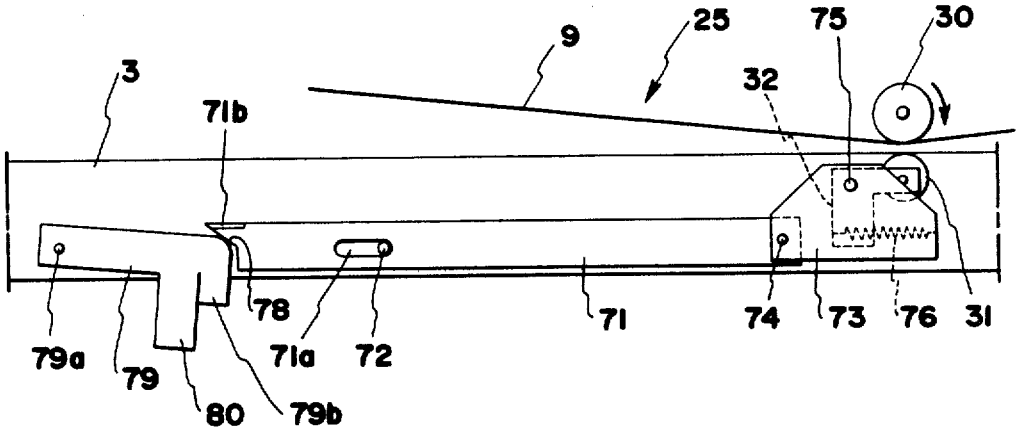
FIGS. 11A to 11C illustrate sequential operations of the means of FIG. 10.
Figure 11B:
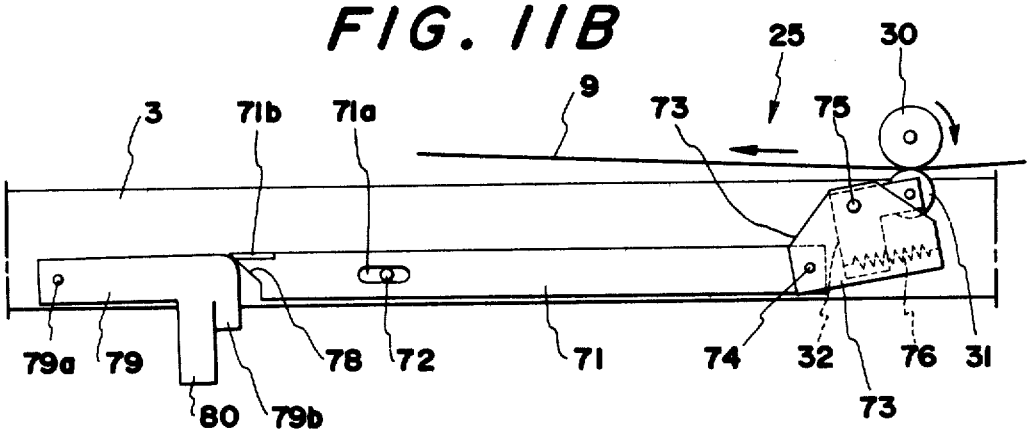

FIGS. 9 to 11 show a further embodiment of the invention which is substantially identical to that of FIGS. 1 to 5, except that the tape back tension means 25 is modified. The tape back tension means 25 comprises an operating arm 71 having an elongated hole 71*a* through which extends a pin 72 secured to the arm 3. One end of the operating arm 71 is connected to a pivotal frame 73 by a pin 74 extending through the operating arm 71 and the pivotal frame 73. The lever 32 on which the pressure roller 31 of the back tension means 25 is mounted is pivotally mounted on the pivotal frame 73 by a pin 75 extending through the arm 3, the pivotal frame 73 and the lever 32. A spring 76 is provided between the lever 32 and the frame 73 and serves to urge the pressure roller 31 against the drive roller 30, while a spring 77 is provided between the arm 3 and the pin 74 and serves to urge the pressure roller 31 away from the drive roller 30. The other end of the operating arm 71 has a downward facing inclined edge 78 which is engaged with an operating lever 79 pivotally mounted on the arm 3 at the point 79*a* thereof. The operating lever 79 includes a downward extension 80 which is faced with an adjustable rod 81 secured to the base 2 as shown in FIG. 9. As shown in FIG. 10, the operating arm 71 has a beveled edge 71*b* provided at the upper edge of the other end of the operating arm 71 while the operating lever 79 has a pawl 79*b* depending from the lever 79 and curved in the same direction as the beveled edge 71*b* of the operating arm 71.

Figure 11C:
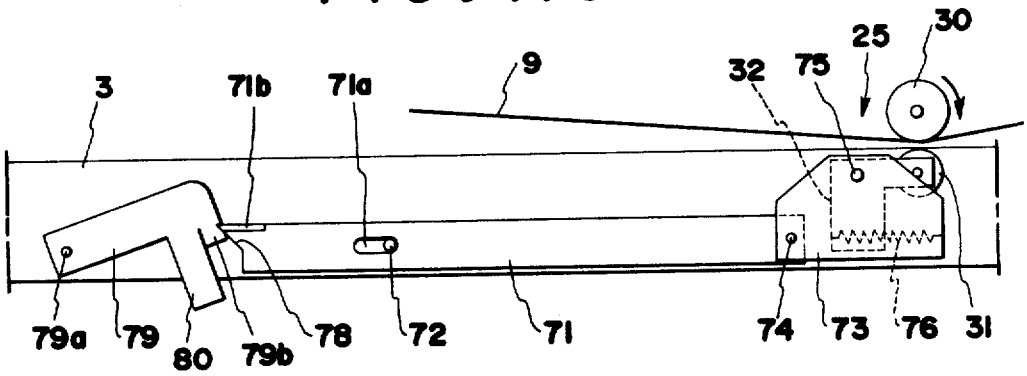

When the arm 3 is at the non-working position as shown in FIG. 9, the pressure roller 31 is away from the drive roller 30 as shown in FIG. 11A. This is caused by the fact that operating lever 79 is at a lower position and that the operating arm 71 is at a leftward position. Thus, it will be noted that the tape 9 can pass through the back tensioning means 25 without any friction so that the article 41 can be easily placed on the tape portion 9' extending through the working head 34 and the working stand 44 so as to be lapped by the tape (see FIG. 1). When the arm 3 is pivotally moved until the extension 80 of the operating lever 79 reaches the adjustable rod 81, the operating lever 79 is pivotally moved about the point 79*a* in a counterclockwise direction as viewed in FIG. 11, with the result that the operating arm 71 is moved against the spring 77 in a rightward direction by engagement of the operating lever 79 with the inclined edge 78 of the operating arm 71. Thus, the pivotal frame 73 is rotated about the pin 74 so that the pressure roller 31 is forced against the drive roller 30. This causes the tape 9 to be pulled back by the rotation of the drive roller 30 in a clockwise direction as viewed in FIG. 11, which is accomplished by engagement of the clutch means 16. At the working position of the arm 3, when it is further moved until the cutter 42 and the tape leading member 43 are operated, the upper edge of the operating lever 79 moves beyond and is disengaged from the inclined edge 78 of the operating arm 71 as shown in FIG. 11C. Thus, the operating arm 71 is returned to the original position by the spring 77 so that the pressure roller 31 is moved away from the drive roller 30. At this time, the tape 9 is released from the back tensioning means 25. The beveled edge 71*b* of the operating arm 71 and the pawl 79*b* of the operating lever 79 serve to easily return the operating lever 79 to the original position as shown in FIG. 11A. According to the embodiment of FIGS. 9 to 11, excessive back tension is never applied to the tape 9.

While some preferred embodiments of the invention have been described and illustrated with reference to the accompanying drawings, it will be understood by those skilled in the art that such are exemplary only, and that various changes and modifications may be made without departing from the spirit and scope of the invention, which is intended to be defined by the appended claims.

What is claimed is:

1. A device for binding thermally adhesive tape around articles to be bundled, said device comprising:

a base frame;

an arm pivoted to said base frame and pivotably movable between a working position and a non-working position, said arm having a free end;

a working head provided on said free end of said arm;

a tape supply mounted on said base frame for supplying a leading end of tape over said free end of said arm;

a working stand mounted on said base frame at a position to be faced with said working head when said arm is pivoted to said working position;

tape holding means, mounted on said working stand, for releasably holding said tape leading end;

whereby, when said arm is in said non-working position, articles to be bundled may be placed in a tape portion extending between said working head and said tape holding means;

said working head including tape bundling means for, upon movement of said arm to said working position, wrapping said tape portion around said articles to be bundled, holding the thus wrapped tape portion against said working stand, and for releasing said tape holding means from said tape leading end;

heater means, provided on one of said working head and said working stand, for bonding said wrapped tape portion;

cutter means on said working head for cutting the thus bonded and wrapped tape portion from a succeeding portion of said tape, thereby forming a released bundle of said articles;

said working head including tape leading means for leading a new tape leading end from said succeeding tape portion to said tape holding means;

a transmission system for moving said arm from said non-working position to said working position, said transmission system comprising a motor, a first gear group driven by said motor, a second gear group, a clutch between said first and second gear groups, said clutch having an engaged position causing said first gear group to drive said second gear group and a non-engaged position interrupting driving between said first and second gear groups, and arm drive means connected to said second gear group and to said arm for pivoting said arm between said working and non-working positions upon said clutch being in said engaged position and upon driving of said second gear group; and clutch engaging means for moving said clutch from said non-engaged position thereof to said engaged position thereof and for thereby moving said arm from said non-working position thereof to said working position thereof, said clutch engaging means comprising an article receiving table positioned to receive and entirely support thereon said tape portion and said articles to be bundled, said table being mounted to be depressed upon receipt of said tape portion and articles to be bundled, and lever-linkage means, mounted between said table and said clutch, and operable upon depression of said table, for moving said clutch from said non-engaged position thereof to said engaged position thereof, said lever-linkage means comprising a clutch releasing member mounted for movement between a first position in contact with said clutch and thereby maintaining said clutch in said non-engaged position out of contact with said clutch and thereby and a second position allowing said clutch to move to said engaged position, spring means for urging said clutch to said engaged position, and linkage means connected to said clutch releasing member for moving said clutch releasing member to said second position thereof upon depression of said table.

2. A device as claimed in claim 1, wherein said tape holding means comprises an opening in said working stand, a tape holding bar slidably provided in said working stand and having a tip engageable with said opening, so that said tip pierces said tape leading end, and urging means to urge said tape holding means toward said opening.

3. A device as claimed in claim 2, wherein said tape holding means further comprises a tape releasing member provided in said working head to engage said tip of said tape holding bar so as to release it from said opening.

4. A device as claimed in claim 1, wherein said tape holding means comprises a tape holding roller, urging means for urging said tape holding roller against a wall of said working stand so as to hold said tape leading end between said tape holding roller and said wall.

5. A device as claimed in claim 4, wherein said tape holding means further comprises a tape releasing member provided in said working head to engage said tape holding roller so as to release it from said wall.

6. A device as claimed in claim 1, further comprising back tension means, mounted on said arm, for applying to said tape a tension in the direction of said tape supply upon movement of said arm to said working position.

7. A device as claimed in claim 6, wherein said back tension means includes a drive roller, a pressure roller, means for normally urging said pressure roller away from said drive roller, and means for forcing said pressure roller against said drive roller when said arm is pivotally moved to said working position.

* * * * *